United States Patent [19]

Tsukushi et al.

[11] 4,423,298

[45] Dec. 27, 1983

[54] GAS CIRCUIT BREAKER OF RESISTANCE BREAKING TYPE

[75] Inventors: Masanori Tsukushi; Youichi Ohshita; Kunio Hirasawa; Takeshi Takahashi, all of Hitachi, Japan

[73] Assignee: Hitachi, Ltd., Tokyo, Japan

[21] Appl. No.: 311,741

[22] Filed: Oct. 15, 1981

[30] Foreign Application Priority Data

Oct. 20, 1980 [JP] Japan ..... 55-145803

[51] Int. Cl.[3] ..... H01H 33/16

[52] U.S. Cl. ..... 200/144 AP; 200/145; 200/148 A

[58] Field of Search ..... 200/148 A, 148 D, 145, 200/146 R, 144 AP, 148 F, 149 R, 148 R, 154, 153 SC

[56] References Cited

U.S. PATENT DOCUMENTS

| | | | |
|---|---|---|---|
| 2,981,814 | 4/1961 | Friedrich | 200/148 D |
| 3,783,214 | 1/1974 | Davies | 200/153 SC |
| 4,009,458 | 2/1977 | Kishi et al. | 200/148 A |

*Primary Examiner*—Elliot A. Goldberg
*Assistant Examiner*—Morris Ginsburg
*Attorney, Agent, or Firm*—Antonelli, Terry & Wands

[57] ABSTRACT

Disclosed is a gas circuit breaker of resistance breaking type, which comprises a main breaking unit and a resistance contact mechanism electrically connected in parallel with the main breaking unit for resistively cutting off current. With the opening action of the main breaking unit, a spring used for opening the resistance contact mechanism is energized and the energized force of the spring is released by a releasing mechanism after the current in the main breaking unit is cut off, thereby to act as a drive force to open the resistance contact means.

13 Claims, 4 Drawing Figures

GAS CIRCUIT BREAKER OF RESISTANCE BREAKING TYPE

This invention relates to a gas circuit breaker which includes a main breaking unit and a resistance breaking unit electrically connected in parallel therewith.

The voltage level used in power transmission systems and the capacity thereof are increasing with increasing demand for power. In Japan, UHV power transmission systems that can transmit power of an order of 1,000 kV are being planned. In the UHV system, it is necessary to suppress or restrict surge voltages to a very low level. This necessitates the use of circuit breakers of resistance breaking type.

The circuit breaker of resistance breaking type includes a main breaking unit and a resistance breaking unit electrically connected in parallel therewith. The resistance breaking unit includes a series connection of a resistor and a resistance contact mechanism. When opening the circuit breaker, the main breaking unit is first opened, thereby causing the current in the circuit to shift into the resistance contact mechanism. With a subsequent opening action of the resistance contact mechanism, the circuit current which has been reduced through the resistor is cut off.

The operation of this circuit breaker to open the circuit, however, involves a problem which is concerned with the opening action of the resistance contact mechanism. The main breaking unit is usually made of a puffer type used in a high-voltage large-capacity circuit breaker. This puffer type breaking unit is provided with a gas compressor which compresses a gas and lets the compressed gas be blown out to extinguish a spark arc which is generated at the opening operation. Therefore, an extra stroke for operating the gas compressor is required for the breaking unit in the breaking or opening operation compared to other types of circuit breakers. Therefore, where the main breaking section and resistance contact mechanism are both operated for the opening action by a single drive unit, large operating power and long stroke are required for the driving unit. These requirements involve a highly technical problem.

Accordingly, it has been proposed to drive the resistance contact mechanism for the opening operation of the circuit by a separate driving unit. For example, Japanese Utility Model application Laid-Open No. 4136/1981 discloses a spring mechanism used for driving the resistance contact mechanism for the opening action. The spring is energized by compression when the main breaking circuit is driven to close the circuit, and the spring force is released at a predetermined timing so as to effectively open the resistance contact mechanism. More particularly, the spring is locked at the energized state by a hook mechanism, and released at the predetermined timing in the opening operation.

The construction could energize the spring at the operation of closing the circuit which is achieved by a small operating force, and therefore was believed to be successful. However, it has been found that the merit of this design in that the driving unit is enough to provide a small operating force and hence be made with small and simple construction, is cancelled by the addition of the spring. The spring force acts as a counter-force against driving of the driving unit and becomes maximum when the resistance contact mechanism reaches near to its closing position. Therefore, difficult problems are involved to satisfy various necessary characteristics of the spring used for opening the resistance contact mechanism.

An object of an invention is to provide a gas circuit breaker of resistance breaking type, which can improve the characteristics in opening of the resistance contact mechanism without increasing the size of the driving unit for closing the circuit breaker.

Another object of the invention is to provide a construction, in which the spring for opening the resistance contact mechanism is arranged in such a manner so as not to increase the axial dimension of the breaking section.

The gas circuit breaker according to the invention uses a spring mechanism for operating a resistance contact mechanism for its opening action. The spring is energized by making use of a force exerted to drive a main breaking unit for the opening action prior to opening the resistance contact mechanism. The force required for energizing the spring is less than the operating force required for driving the puffer type main breaking unit for the opening action. In addition, in the driving unit for opening the main breaking unit, its large operating power is required only in a very short period of time at the beginning of its opening stroke, and its excess energy has to be absorbed in the latter half of the stroke. The excess energy can be effectively utilized for energizing by compression the spring, whose counter-force, gradually increases. Thus, a good harmony can be obtained in operating power between the opening spring and the driving unit, and the afore-mentioned objects can be attained without imparting the counter-force to the closing driving unit. Embodiments of the present invention will now be described with reference to the accompanying drawings in which:

Figure 1:
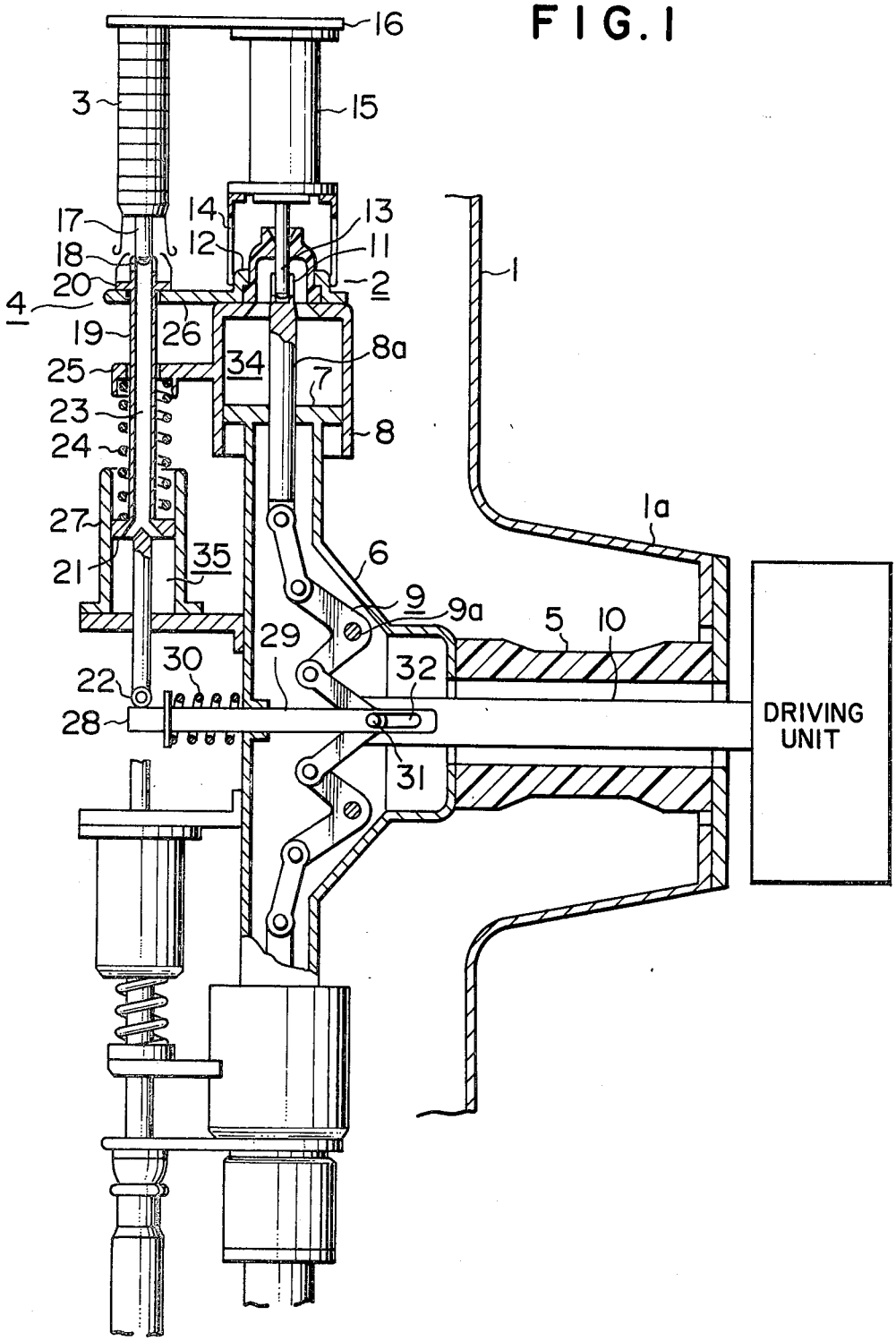
FIG. 1 is an axial sectional view of an embodiment of a tank-type gas circuit breaker of resistance breaking type according to the invention.

As shown in FIG. 1, a tank 1 is filled with an arc-extinguishing gas such as $SF_6$ and acomodates breaker units. Each of the breaker units includes a main breaker unit 2 and a resistance breaker unit electrically connected in parallel therewith. The resistance breaker unit includes a series connection of a resistor 3 and a resistance contact mechanism 4. The tank 1 as a projected cylindrical wall 1*a*. An insulating hollow cylindrical support 5 has one end secured to the inner end wall of the projected cylindrical wall 1*a*, and carries a bracket 6 secured to the other end. The upper and lower halves of the bracket 6 are symmetrical in construction, so only the upper half thereof will be described. A piston 7 is secured to the bracket 6, and a puffer cylinder 8 is slidably fitted on the piston 7. The piston 7 and cylinder 8 form a compressor for compressing gas in a space or chamber 34 defined by them. The cylinder 8 has a center rod 8*a*, which is linked, via a link mechanism 9, to one end of an insulating operating rod 10 which extends through the insulating hollow cylindrical support 5. The other end of the insulating operating rod 10 is coupled to a suitable driving unit. The puffer cylinder 8 carries a movable arc contact 11 and a movable main contact 12. These contacts are respectively paired with a fixed arc contact 13 and a fixed main contact 14. The contacts 13 and 14 are secured in the illustrated position together with a support conductor 15 by suitable insulating support means. The end of the resistor 3 is secured to the insulating support and is electrically connected through the conductor 16 to the support conductor 15.

The resistor 3 carries a fixed resistance contact 17 secured to its other end. A movable resistance contact 18 is secured to a movable shaft 19 and cooperates with the fixed resistance contact 17. The movable shaft 19 integrally has a flange 20 and a piston 21, and also carries a roller 22 rotatably mounted at its lower end. The piston 21 is slidable in a cylinder 27 which is secured to the bracket 6. With an opening action of the movable resistance contact 18, gas filled in a chamber 35, defined by the piston 21 and cylinder 27, is compressed and forced through the bore 23 of the movable shaft 19 to be blown out toward the area near to the contacts 17 and 18. A compression spring 24 serves to evvect the opening action of the movable resistance contact 18. This compression spring 24 is disposed between the piston 21 and a first arm 25 which is slidably movable with respect to the movable shaft 19 and is secured to the puffer cylinder 8. Thus, the compression spring 24 is energized by the opening action of the puffer cylinder 8. The movable main contact 12 of the main breaking unit 2 is integral with a second arm 26. The second arm 26 engages the flange 20 and drives the movable resistance contact 18 in the direction to make the circuit at the time of a closing the main breaker unit 2. The second arm 26 may be omitted so that the engagement between the first arm 25 and flange 20 is established for the purpose.

The roller 22 is restricted to the illustrated position by a stopper 28. The stopper 28 is coupled to the link 29 of the link mechanism 9 and biased by a spring 30 so that it normally assumes the illustrated position. The link 29 has an elongate hole 32 formed near its right hand end, and a pin 31, connecting the link 29 and insulating operating rod 10, is slidably received in the elongate hole 32. When the insulating operating rod 10 is driven to open the circuit, the link 29 is not driven before the pin 31 reaches the right-most end of the elongate hole 32.

In the embodiment of FIG. 1, the respective movable shafts 19 of the pair of resistance breaking units as above-mentioned are arranged to move along separate axes so that their opposing ends will not strike each other.

Now, the opening operation will be described. To open the circuit when located at the closed state in FIG. 1, the drive unit is operated to drive the insulating operating rod 10 to the right. This action causes a movement of the puffer cylinder 8 to compress the gas in a chamber 34 and also breaks the connection between the contacts 12 and 14 and then the connection between the contacts 11 and 13. The arc that is generated between the contacts 11 and 13 is extinguished by high pressure gas blown out from the chamber 34. Concurrently with this action, the following two actions take place. The first action is the compression of the compression spring 24 by the first arm 25 integral with the puffer cylinder 8. This first action is brought about independently of the opening action of the resistance contact 18. The second action is a movement of the pin 31 in the elongate hole 32. This motion eventually couples the insulating opening rod 10 and link mechanism 9 in the direction to open the circuit at a timing when the puffer cylinder 8 and movable contacts 11 and 12 reach a position to completely cut off the current. By the term "a position to completely cut off current" is meant a position, at which arc generated between the contacts 11 and 13, broken apart at whatever phase, is completely extinguished. The opening operation is continued from this position unitl an opening final position is reached, while the stopper 28 is separated from the roller 22. The reaching of the opening final position by the insulating operating rod 10 brings an end to the opening operation caused by the drive unit.

It will be appreciated that the roller 22 is released from it engagement with the stopper 28 only after the current in the main breaking unit 2 is cut off, so that the circuit current is already shifted to flow through the resistance breaking unit including the resistor 3 and resistance contacts 17 and 18. Also, at this time the compression spring 24 is energized with its maximum, spring force.

Upon releasing the restrainment of the roller 22 by the stopper 28, the movable resistance contact 18 is driven downwards by the compression spring 24 and broken apart from the counterpart fixed resistance contact. The arc that is generated at this time is extinguished by the compressed gas blown out from the chamber 35. The arc extinguishment at this time is effected by a comparatively small-size gas blow-out means since current has been limited through the resistor 3.

In the closing operation, closing resistor means is first closed, and then the operating rod is moved to the left-hand position to close the main contacts 12, 14 as shown in FIG. 1. The second arm 26 is moved together with the cylinder 8 when the operating rod 10 is moved to the left-hand position thereby driving the movable shaft 19 carrying the movable resistive contact 18 to close the circuit and, after the closure, holds the movable resistance contact 18 in the "on" state. The stopper 28 also serves to hold the "on" state. Where the resistor 3 is used for the closing resistor, resistance contact mechanism 4 has to be brought to the closing position prior to closing the main breaking unit 2, and also it is necessary to set a large wipe distance between the contacts 17 and 18.

Figure 2:
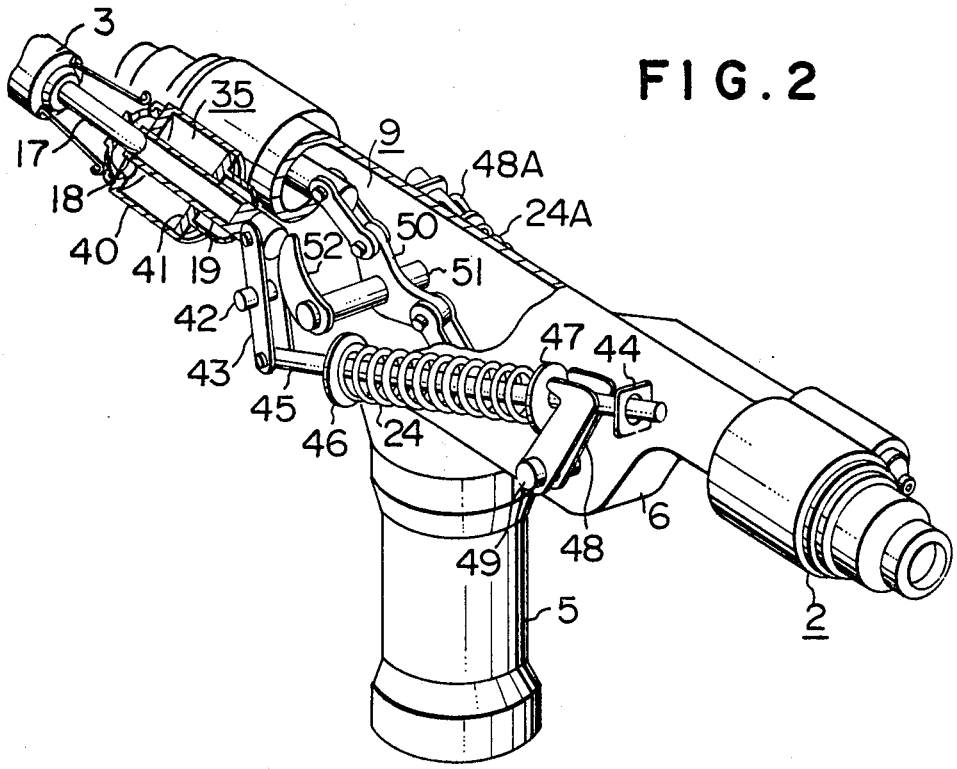
FIG. 2 is a prespective view, partly in section, showing a different embodiment of the gas circuit breaker of resistance breaking type according to the invention.

As shown in FIG. 2, wherein like reference numerals are used to designate like parts, a cylinder 40 is coupled to the movable shaft 19 connected to the movable resistance contact 18 in the resistance contact mechanism 4. A piston 41, which is secured to the bracket 6, is slidably fitted in the cylinder 40. The cylinder 40 and piston 41 define a chamber 35. With an action of the movable resistance contact 18 to open the circuit, gas in the chamber 35 is compressed and blown against arc generated between the contacts 17 and 18. One end of the movable shaft 19 is connected to one end of a lever 43 having a rotary shaft 42. The other end of the lever 43 is connected to one end of a rod 45 supported by a guide 44. The rod 45 carries a stationary spring seat 46 secured to it. A compression spring 24 is provided between the stationary spring seat 46 and a movable spring seat 47 movably fitted on the rod 45. As the lever 48 is rotated, the movable spring seat 47 is moved to compress the spring 24. The rotary shaft 49 of the lever 48 corresponds to the rotary shaft **9*a* of the link mechanism 9 described earlier in connection with FIG. 1. With the opening action of the main breaking unit 2 the rotary shaft 49 is thus rotated to compress the spring 24. The link mechanism 9 of the main breaking unit on the left hand of FIG. 2 includes an L-shaped lever 50 having a rotary shaft 51. The rotary shaft 51 has a lever 52 provided at its one end. The lever 52 is in contact with the end face of the movable shaft 19. With the action of the main breaking unit to close the circuit, the lever 52 is rotated counterclockwise to drive the movable resistance contact 18 to close the circuit via the movable shaft 19. The rotary shaft 51, like the rotary shaft 49, is provided at its other end with a rotary lever 48A for compressing the spring 24A**.

It will be understood that the springs 24 and 24A are provided on the opposite sides of the bracket 6. These springs each serve to drive each resistance contact mechanism 4 to open the circuit, and are energized through the rotary shafts 49 and 51 with the opening action of the other main breaking unit.

When the L-shaped lever 50 is rotated clockwise in unison with the rotary shaft 51 with the opening action of the main breaking unit, the lever 52 is also rotated in the same direction. With the rotation of the lever 52, the movable shaft 19 is allowed to move in the direction to open the circuit. Concurrently with this action, the rotary shaft 49 is rotated counterclockwise to compress the spring 24 via the movable spring seat 47. The compressed spring 24 tends to drive the rod 45 to the left and also to rotate the lever 43 clockwise, but this effort is blocked by a locking unit.

Figure 3:
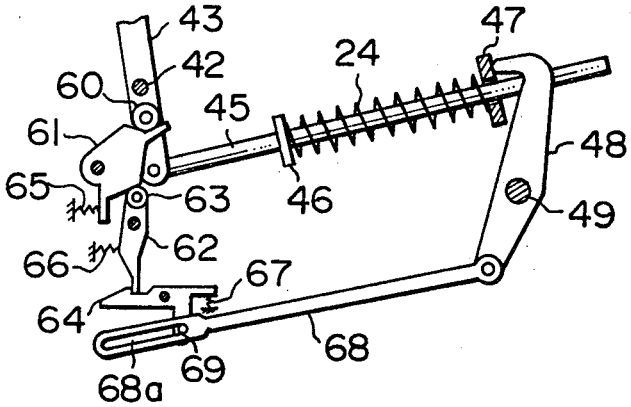
FIG. 3 is a plan view showing a portion of the embodiment of FIG. 2.

FIG. 3 shows an an example of the locking unit. The lever 43 carries a roller 60 rotatably mounted near its rotary shaft. The roller 60 is in engagement with a first hook 61. The acting point by force of the spring 24, the engagement surface thereof and the position of the rotary shaft are arragned such that the first hook 61 is urged to rotate clockwise. The rotation of the first hook 61, however, is prevented by a roller 63 carried by a second hook 62. The rotational force of the first hook 61 has a component acting as a torque for clockwise rotation on the second hook 62. The rotation of the second hook 62, however, is prevented by a third hook 64 in engagement with the second hook 62. The individual hooks 61, 62 and 64 are set in the illustrated positions by respective positioning bias springs 65, 66 and 67. The lower end of the lever 48 is linked to one end of a link 68, and the other end thereof is linked with a play to a pin 69 projecting from the third hook 64. The play is given by an elongate hole **68*a* formed in the link 68. In the illustrated state, in which the cirucit is closed, the pin 69 is positioned at the right hand end of the elongate hole 68*a*. The counterclockwise rotation of the lever 48 is not transmitted to the pin 69 until a predetermined period of time is elapsed, which is determined by the length of the elongate hole 68*a***.

With this locking unit, the spring 24 is compressed without the rotation of the lever 43 in FIG. 2. The compression of the spring 24 is continued until the main breaking unit reaches a position where its current is completely cut off. When this position is reached, the pin 69 in FIG. 3 is at the left hand end of the elongate hole **68*a*. With further rotation of the lever 48 caused by the rest of the stroke up to the final closing position, the third hook 64 is rotated counterclockwise by the pin 69. This rotation causes the clockwise rotation of the second hook 62 and clockwise rotation of the first hook 61. Consequently, the force of the spring 24 is allowed to act upon the lever 43. The roller 60 is thus moved while causing the clockwise rotation of the first hook 61, and clockwise rotation of the lever 43. The rotation of the lever 43 is transmitted to the movable resistance contact 18 to be used as a force for driving the resistance contact mechanism to open the circuit. The arc generated between the contacts 17 and 18 is extinguished by the compressed gas blown out from the chamber 35, and a completely "off" state of the ciruit is obtained. Even in this "off" state, the individual hooks are not in engagning state since the first hook 61 has been rotated clockwise by the roller 60. Also, the end face of the movable shaft 19 is in contact with or in the proximity of the lever 52**, which has been previously moved.

When the closing operation is subsequently caused, the movable shaft 19 is thus driven in the closing direction with the counterclockwise rotation of the lever 52, thus closing the contacts 17 and 18. At the same time, the lever 48 is rotated clockwise. At this time, the link 68 does not transmit any force to the pin 69 which is located at the left hand end of the elongate hole **68*a*. However, the counterclockwise rotational force previously exerted to the third hook 64 via the pin 69 is removed. As a result, the third hook 64 is restored to the state of FIG. 3 by the positioning bias spring 67. At this time, the first and second hooks 61 and 62 are not yet been restored. At the end of the closing operation, the roller 60 is brought into engagement with the first hook 61 as shown in FIG. 3, thus causing the restoration of the second hook 62 to the illustrated state. The second hook 62 is rotated clockwise, as it is restored thereby causing slight counterclockwise rotation of the third hook 64 to the position shown in FIG. 3**.

Figure 4:
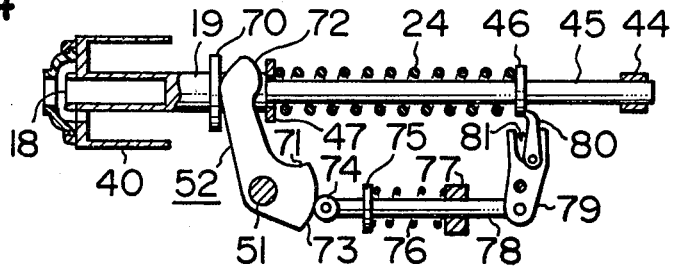
FIG. 4 is a plan view showing a modification of the portion of FIG. 3.

FIG. 4 shows a different example of the locking unit. In this example, the compression of the spring 24 is effected by a lever 52.

Here, the rod 45 is coupled via a flange 70 linearly to the movable shaft 19. The spring 24 is provided between a stationary spring seat 46 secured to the rod 45 and a movable spring seat 47 movably fitted on the rod 45. The lever 52 has an engagement portion 72 which is located between the flange 70 and the movable spring seat 47. With the counterclockwise rotation of the lever 52, the engagement portion 72 causes the movable resistance contact 18 to be closed. Also, with the clockwise rotation of the lever 52 the spring 24 is compressed by the engagement portion 72 via the movable spring seat 47. The lever 52 thus has the function of the lever 48 as well. The lever 52 has a cam formed at its other end. In engagement with the cam is a roller 74 carried by a rod 78. A spring 76 is provided between a spring seat 75 secured to the rod 78 and a guide 77 secured to the bracket 6. The spring 76 serves to cause the roller 74 to follow the cam. The cam has an arcuate portion 73 concentric with the rotary shaft 51 and of a certain radius of curvature and a reduced radius of curvature portion 71 formed adjacent to the portion 73. The length of the arcular portion 73 of the cam is set such that the roller 74 reaches the reduced radius-of-curvature portion 71 when the main breaking unit reaches a position where its current is completely cut off. When the roller 74 reaches the reduced radius-of-curvature portion 71, the rod 78 is moved to the left by the spring 76, thus causing clockwise rotation of the lever 79 and hook 80. Thus, the stationary spring seat 46 is released from locking by the hook 80. As a result, the released spring 24 pushes the rod 45 thereby to drive the movable resistance contact 18 to open the circuit. This action is the same as in the previous embodiment.

The closing operation is effected by rotating the lever 52 counter-clockwise. When the roller 74 moves from the reduced radius-of-curvature portion 71 to the portion 73, the lever 79 and hook 80 are restored to the state of FIG. 4. Subsequently, the stationary spring seat 46 exceeds the hook 80, causing momentary counterclockwise rotation of the hook 80 against the spring 81. According to this embodiment, the driving source for the resistance contact mechanism is given by a single breaking unit. Where the basic construction includes two breaking units as in the case of FIG. 2, two springs 24 are disposed separately on the opposite sides of the bracket 6. This has an effect of greatly reducing the axial dimension of the two breaking units. Further, while the above embodiment employ a compressor constructed with the piston 21 or 41 and cylinder 27 or 40, it is also possible to use an expander whose inner space is increased with movement of one of the movable members and to let the gas withdrawn into the expander act between the contacts 17 and 18. In either case, a gas blow-out device for cutting off the current flowing through the resistor 3 is provided.

What is claimed is:

1. A gas circuit breaker of resistance breaking type comprising:

a main breaking unit driven by a drive unit to open and close a circuit;

a resistor and a pair of resistance contacts electrically connected in parllel with said main breaking unit, said pair of resistance contacts including a fixed and movable contact;

spring means for storing a spring force with an action of said drive unit in driving said main breaking unit to open the circuit;

means for coupling said spring means with the movable resistance contact so that said spring means acts, as a source of a drive force, on said movable contact to open said pair of resistance contacts;

locking means for locking said movable contact in a closed position wherein said pair of resistance contacts are closed;

releasing means for releasing the locking effected by said locking means after current in said main breaking unit has been cut off; and means for transmitting a closing action of said main breaking unit by said drive unit to said movable contact to close said pair of resistance contacts.

2. A gas circuit breaker of resistance breaking type according to claim 1, which further comprises gas blow-out means for generating a gas stream with an opening action of said movable contact by said spring means, and guide means for causing the gas stream generated by said gas blow-out means to act on said resistance contacts.

3. A gas circuit breaker of resistance breaking type comprising:

at least two main breaking units, each of said breaking units including a fixed contact and a movable contact, said contacts being capable of being selectively closed or opened;

bracket means for movably supporting the movable contacts of said two main breaking units at an axially opposing end thereof so as to enable the movable contacts of said two main breaking units to be closed or open from the counterpart fixed contacts of said two main breaking units;

insulating support means fixedly supporting said bracket means;

link means supported by said bracket means and having a first end connected to an associated movable contact and a second end adapted to be connected to a drive means;

an electrical series connection of a resistor and a resistance contact mechanism electrically connected in parallel with each of said main breaking units, said resistance contact mechanism including a fixed resistance contact and a movable resistance contact movably supported by said bracket means to be closed and opened from the fixed resistance contact;

two spring means disposed separately at both sides of said bracket means, each of said spring means being adapted to be energized to store a force useful for driving the associated movable resistance contact to be opened from the fixed resistance contact;

lever means for energizing each of said spring means with an opening action of the associated main breaking unit;

locking means for locking said movable resistance contact at a closing position;

releasing means for releasing the locking effected by said locking means after the current in each of said main breaking units is cut off; and means for transmitting a closing action by the drive means tro move each of said movable resistance contacts into the closing position.

4. The gas circuit breaker of resistance breaking type according to claim 3, wherein said link means includes a lever having a rotary shaft to which said lever means is connected.

5. The gas circuit breaker of resistance breaking type according to claim 4, wherein each of said spring means includes a first end connected through rod means to the associated movable resistance contact and a second end cooperable with a movable spring seat mounted on said rod means, said lever means transmitting an opening action of said drive means through said movable spring seat, and said transmitting means includes a flange secured to said rod means and capable of being engaged with and driven by said lever means with a closing operation of said drive means.

6. The gas circuit breaker of resistance breaking type according to claim 4, wherein said releasing means has a first end connected to said rotary shaft and a second end connected with a play to said locking means, the lock effected by said locking means being released by said releasing means when said link means, is operative.

7. A gas circuit breaker of a resistance breaking type comprising:

main breaking means including at least a pair of main contacts, said main breaking means being adapted to be driven by a drive unit to open and close said main contacts;

resistor breaking means including a resistor and a pair of resistance contacts adapted, when closed, to electrically connect said resistor in parallel with said main contacts;

spring means for storing, when energized, a spring force capable of driving said resistor breaking means to open said resistance contacts;

means for mounting said spring means with a first end thereof operatively engaged with said main breaking means and a second end thereof operatively engaged with said resistor breaking means so that an opening action of said main breaking means acts to energize said spring means and the spring force stored by said spring means acts in a direction to close said main breaking means and also in a direction to open said resistor breaking means;

locking means for locking said resistor breaking means at a closed position when said main contacts are closed;

releasing means for releasing said resistor breaking means from a locking effect of said locking means with a predetermined timed relationship with an opening of said main breaking means; and means for transmitting a driving action of said drive unit to said resistor breaking means when closing said main contacts to close said resistance contacts.

8. A gas circuit breaker of resistance breaking type according to claim 7, further comprising gas blow-out means for generating a gas stream with an opening action of said resistance contacts by said spring means, and guide means for causing the gas stream generated by said gas blow-out means to act on said resistance contacts.

9. The gas circuit breaker of resistance breaking type according to claim 7, wherein said transmitting means is effective to hold said resistance breaking means at its closing position.

10. A gas circuit breaker of resistance breaking type comprising:

at least two main breaking units, each of said breaking units including a fixed contact and a movable contact, said contacts being capable of being selectively closed or open;

bracket means for movably supporting the movable contacts of said two main breaking units, at axially opposing ends thereof so as to enable the movable contacts of said two main breaking units to be closed or opened from the counterpart fixed contacts of said two main breaking units;

insulating support means fixedly supporting said bracket means;

link means supported by said bracket means and having a first end connected to an associated movable contact and a second end adapted to be connected to a drive means so that the associated movable contact is closed and opened from the associated fixed contact by operation of said drive means;

a resistance breaking unit provided for each of said main breaking units and including a resistor and a pair of fixed and movable resistance contacts operable to be opened and closed and adapted, when closed, to connect said resistor in parallel with an associated one of said main breaking units; two spring means disposed separately at both sides of said bracket means, each of said spring means being adapted to be energized to store a spring force for driving the associated movable resistance contact to be opened from the fixed resistance contact;

means for mounting each of said spring means with a first end operatively engaged with an associated one of said main breaking units and a second end operatively engaged with said resistance breaking units provided for each of said main breaking units so that the spring force stored in each of said spring means urges the associated main breaking unit in a direction to close contacts thereof and said associated resistance breaking unit in a direction to open contacts thereof;

lever means for energizing each of said spring means with an opening action of the associated main breaking unit;

locking means for locking said movable resistance contact at a closing position;

releasing means for releasing the locking effected by said locking means with a predetermined timing relationship with an opening of said main breaking unit; and means for transmitting a closing action by the drive means to move each of said movable resistance contacts into the closing position.

11. The gas circuit breaker of resistance breaking type according to claim 10, wherein said link means is connected through a rotary shaft to associated lever means.

12. The gas circuit breaker of resistance breaking type according to claim 11, wherein said one end of said spring means is operatively engaged through rod means with the associated movable resistance contact and the second end thereof is provided with a movable spring seat, said lever means energizes said spring means through said movable spring seat with an opening action of said drive means, and said transmitting means includes a flange secured to said rod means and capable of being engaged with and driven by said transmitting means with a closing operation of said drive means.

13. The gas circuit breaker of resistance breaking type according to claim 10, wherein said releasing means has a first end connected to said lever means and a second end connected with a play to said locking means, the locking effected by said locking means being released by said releasing means when said link means is operative.

* * * * *